US005634811A

United States Patent [19]

Heng et al.

[11] Patent Number: 5,634,811

[45] Date of Patent: Jun. 3, 1997

[54] FAST-ACTING INSULATION-DISPLACEMENT CONNECTOR

[75] Inventors: Jean-Paul Heng, Lyons; Ariel Ruiz, Villeurbanne; Luc Doutaz, Lyons, all of France

[73] Assignee: Entrelec S.A., Villeurbanne, France

[21] Appl. No.: 510,883

[22] Filed: Aug. 3, 1995

[30] Foreign Application Priority Data

Aug. 4, 1994 [FR] France ..... 94 09707

[51] Int. Cl.[6] ..... H01R 4/24

[52] U.S. Cl. ..... 439/412

[58] Field of Search ..... 439/411, 412, 439/413, 417, 460

[56] References Cited

U.S. PATENT DOCUMENTS

| | | | |
|---|---|---|---|
| 4,764,125 | 8/1988 | Debortoli | 439/413 |
| 4,993,966 | 2/1991 | Levy | 439/411 |
| 5,120,235 | 6/1992 | Kashiwa et al. | 439/460 |
| 5,149,278 | 9/1992 | Waas et al. | 439/412 |
| 5,415,562 | 5/1995 | Matsumoto et al. | 439/417 |
| 5,417,581 | 5/1995 | Dechelette et al. | 439/417 |
| 5,423,694 | 6/1995 | Jensen et al. | 439/411 |
| 5,503,567 | 4/1996 | Gow et al. | 439/411 |

FOREIGN PATENT DOCUMENTS

| | | |
|---|---|---|
| WO9215130 | 9/1992 | WIPO . |
| WO9413032 | 6/1994 | WIPO . |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A fast-acting insulation-displacement connector for connecting conductors to a metal strip (13), the connector being provided with insulation-displacement contacts (16), each of which has two sharp parallel edges, the connector being characterized in that it includes pushing means (21, 22, 25) actuated by a screwdriver (24) for pushing the conductor (40) onto the contacts (16). Application to a distribution terminal block.

10 Claims, 3 Drawing Sheets

FAST-ACTING INSULATION-DISPLACEMENT CONNECTOR

BACKGROUND OF THE INVENTION

The present invention relates to a fast-acting insulation-displacement connector, in particular applicable to implementing a distribution terminal block making it possible to connect a plurality of conductors to a common strip by insulation displacement.

SUMMARY OF THE INVENTION

An object of the present invention is to provide an insulation-displacement connector to which conductors can be connected both simply, with an ordinary screwdriver being the only tool required, and quickly, merely by rotating the screwdriver, e.g. through less than 180°.

Another object of the invention is to provide a connector in which it is possible to remove the connected conductors by using an ordinary screwdriver.

The invention provides an insulation-displacement connector for connecting conductors to a metal strip, the connector being provided with insulation-displacement contacts having sharp parallel edges, said connector being characterized in that it includes pushing means actuated by a screwdriver for pushing the conductor onto said contacts.

Advantageously, said pushing means include a well containing a screw that is prevented from moving in translation and that, by being rotated by means of said screwdriver, causes a threaded pusher to move in axial translation, which pusher co-operates with the screw and is prevented from rotating.

The invention also provides a terminal block including at least one insulation-displacement connector as defined above.

In a particular embodiment, the terminal block includes a plastic housing subdivided into compartments, each compartment containing insulation-displacement contacts, a well provided with a screw and a pusher, one opening being provided in the housing for each compartment, the opening being disposed between the bottom of the pusher and the insulation-displacement contacts so that a conductor to be connected can be inserted through the opening, said opening communicating with a slot extending parallel to the edges of the insulation-displacement connector.

According to an important characteristic of the invention, said slot is provided with lips enabling the conductor to be clamped after it has been connected.

Advantageously, said lips are integrally molded with the housing.

According to another characteristic of the invention, the height of the insulation-displacement contacts is equal to a multiple of the diameter of each of the conductors to be connected.

Advantageously, said slot is extended, without its lips, above the level of the insulation-displacement contacts so as to enable a conductor to be extracted merely by being pushed, e.g. by said screwdriver.

The invention is explained in detail below through a description of an embodiment given with reference to the accompanying drawings, in which:

The example described is that of a terminal block, but it is to be understood that the fast-acting insulation-displacement connector of the invention is applicable to any type of equipment in the field of connectors.

DETAILED DESCRIPTION OF THE PREFERRED EMBODIMENTS

Figure 1:
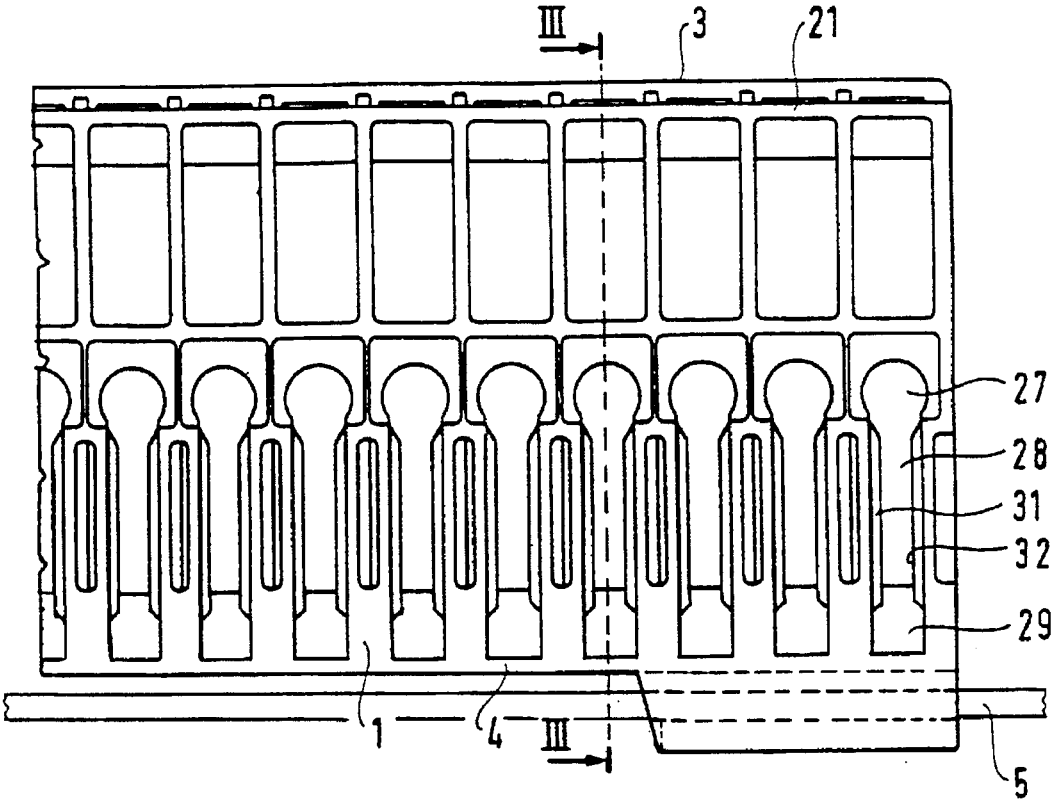
FIG. 1 is a fragmentary elevation view of a terminal block implementing an insulation-displacement connector of the invention.
Figure 2:
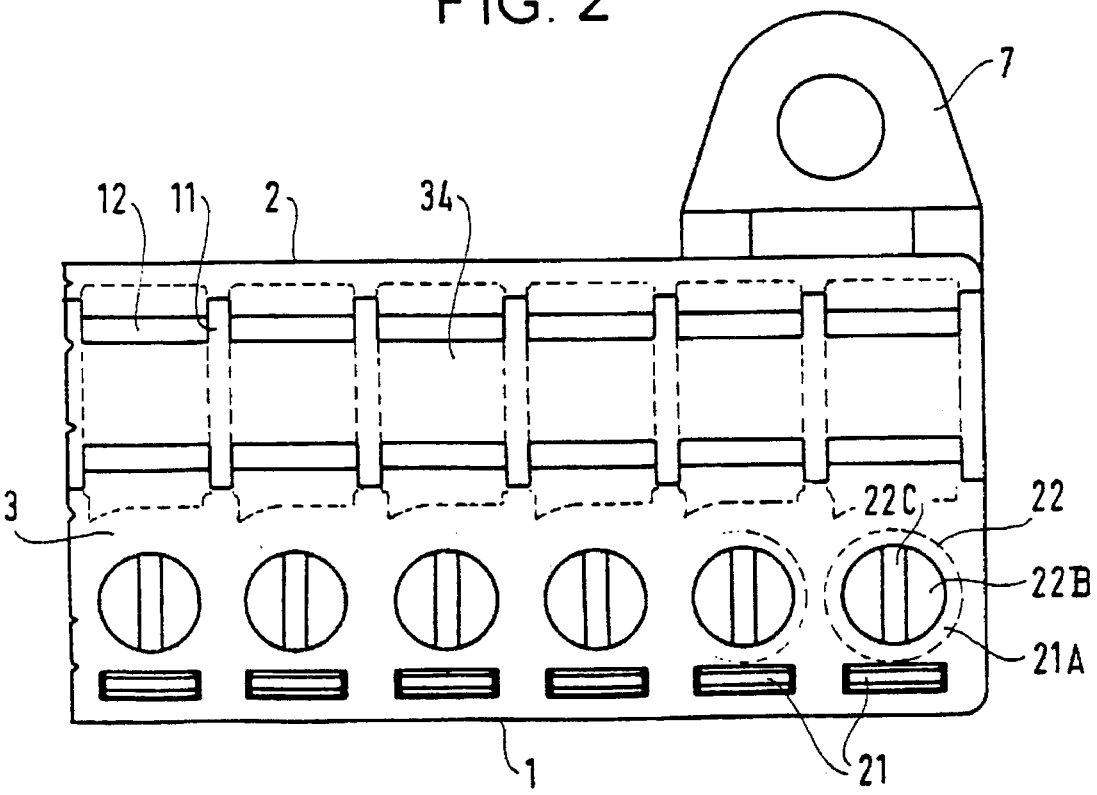
FIG. 2 is a fragmentary plan view of the same terminal strip.
Figure 3:
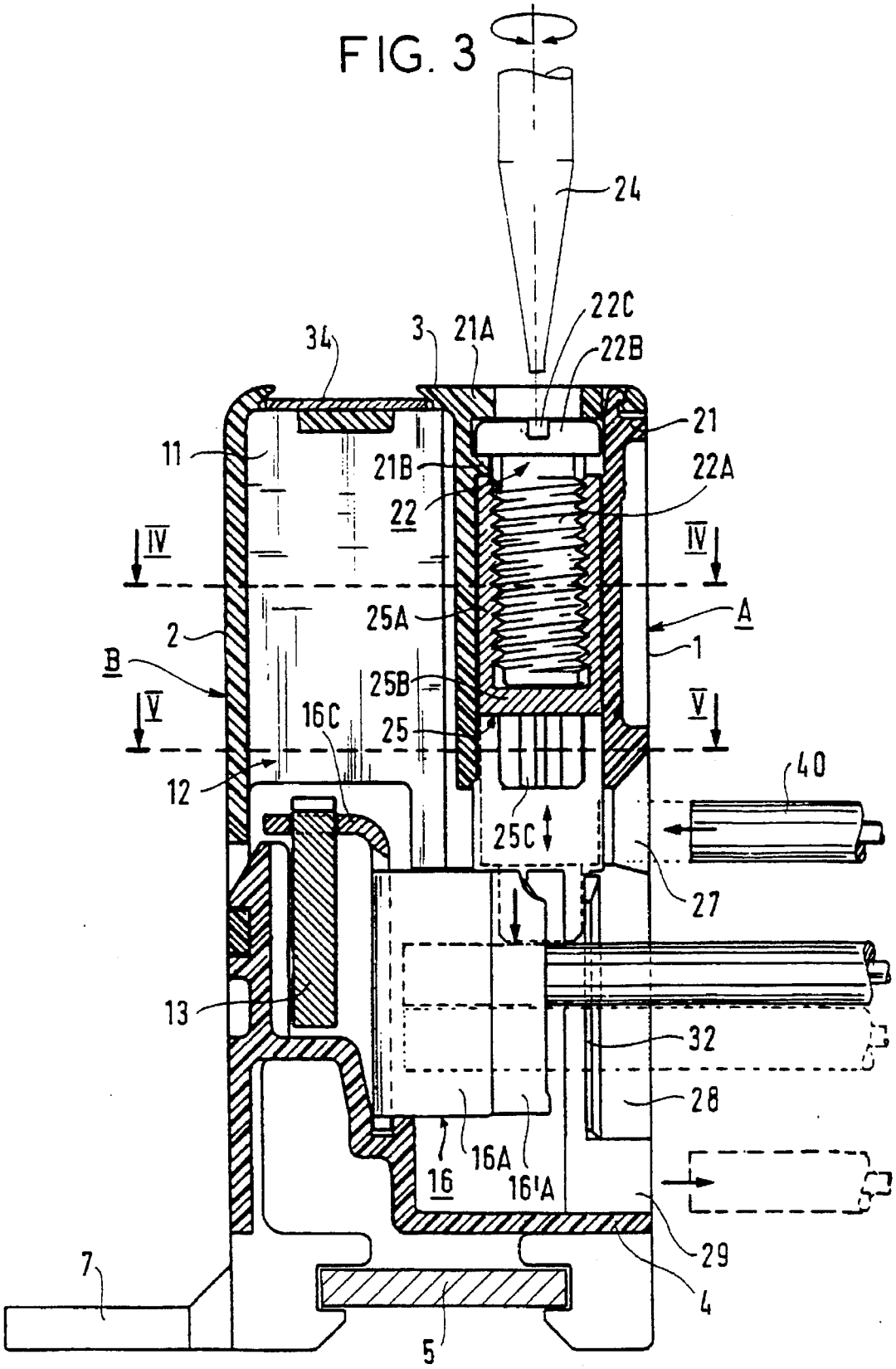
FIG. 3 is a fragmentary section view on line III—III of FIG. 1, drawn to a larger scale than FIGS. 1 and 2.
Figure 4:
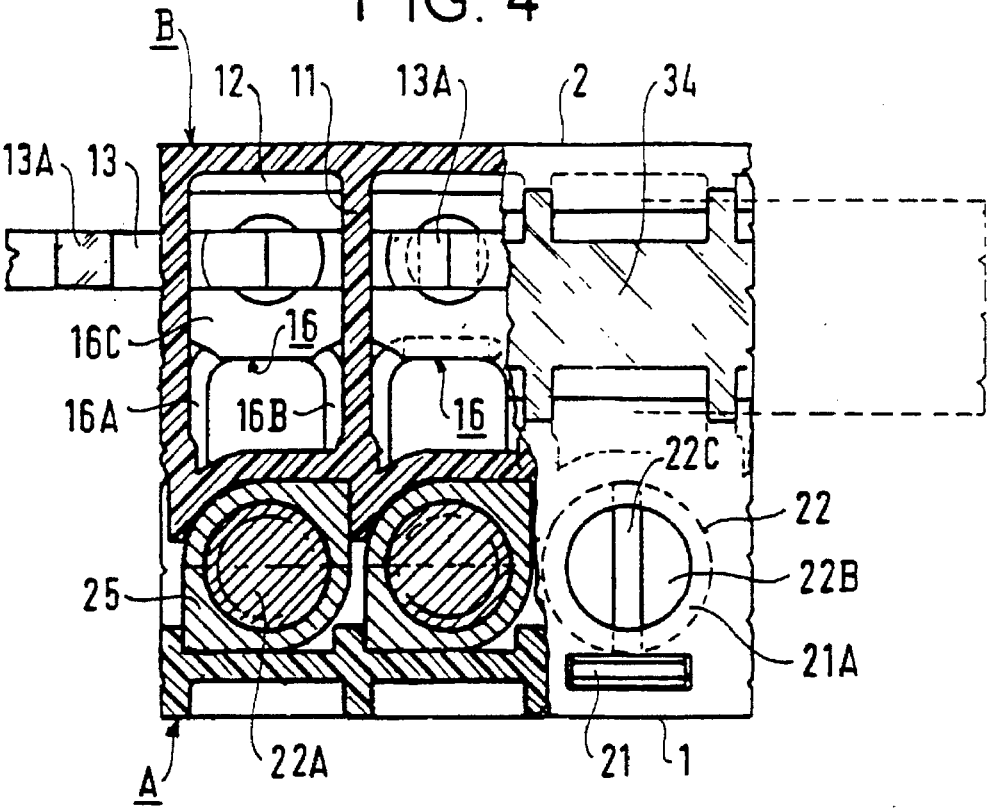
FIG. 4 is a fragmentary section view on line IV—IV of FIG. 3, drawn to a larger scale than FIGS. 1 and 2.
Figure 5:
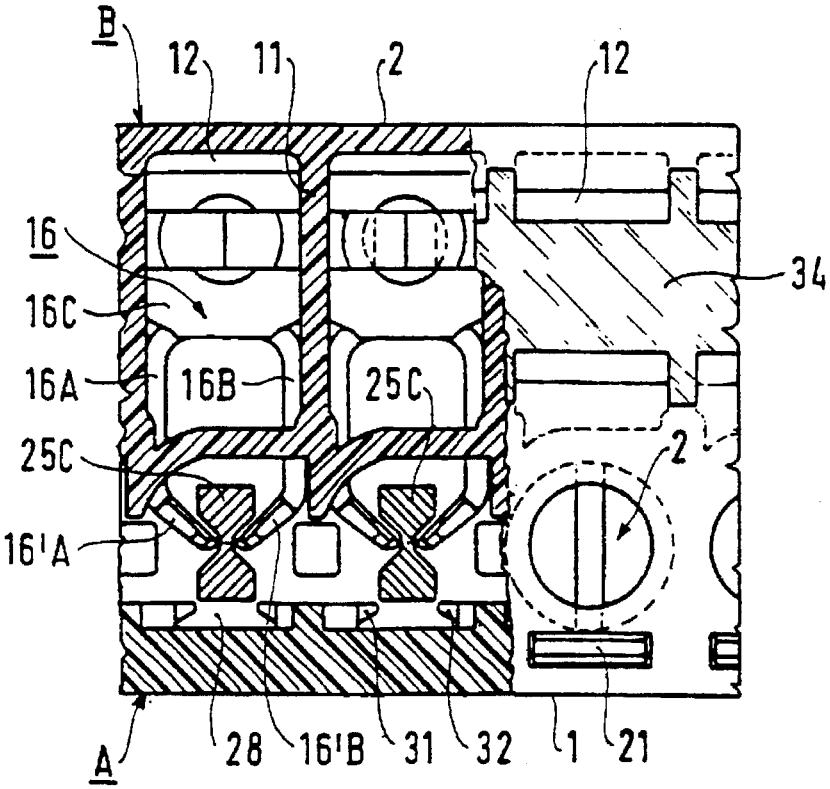
FIG. 5 is a fragmentary section view on line V—V of FIG. 3, drawn to a larger scale than FIGS. 1 and 2.

The terminal block includes a housing made of a plastics material, advantageously made up of two interfitting portions given overall references A and B (see FIG. 3). The resulting assembly defines a substantially rectangular housing having a front face 1, a rear face 2, a top 3, and a bottom 4 that can be secured to a metal fixing rail 5. Portion A includes face 1, the bottom 4, and the bottom portion of face 2. Portion B includes the top 3 and the top portion of face 2. The housing includes transverse partitions 11 defining a plurality of parallel compartments 12, each of which can receive one or more conductors. The partitions 11 are provided with orifices in alignment enabling a metal strip 13 to be engaged therethrough (see FIGS. 3 to 5). The conductors are to be connected to this common strip.

The length of the housing and its height depend on the number of connections to be made. At each end of the housing, an integrally molded lug 7 enables the housing to be fixed.

In each compartment, the strip 13 is secured to insulation-displacement contacts (see FIG. 5) given overall reference 16 below. These contacts are constituted by a plate 16 folded so as to define two parallel portions 16A and 16B terminated by convergent ends 16'A and 16'B having sharp edges, the distance between which is slightly less than the diameter of the metal of the conductors to be connected. The plate 16 is secured to the strip by crimping a suitably folded portion 16C to studs 13A on the strip.

For each compartment 12, the housing includes a portion in the form of a well 21. The well is disposed above the above-described insulation-displacement contacts 16, and it contains a screw 22 having a threaded shank 22A and a head 22B provided with a slot 22C capable of receiving the end of a screwdriver 24. The head of the screw is engaged between two circular shoulders 21A and 21B in portion 21, so that the screw can rotate but is prevented from moving in translation. The screw is used to displace a pusher 25 including a prismatic portion 25A provided with an internal thread, engaged on the screw 22, and secured via a bottom 25B to a prismatic end portion 25C. The cross-section of the well comprises two parallel opposite faces, as does the cross-section of the prismatic portion 25A. In this way, the part 25A is prevented from rotating and can be displaced in axial translation only. The cross-section of part 25C (shown in particular in FIG. 5) is substantially hourglass-shaped, it being possible for the thin portion to engage between the sharp edges of the insulation-displacement contacts. This disposition makes it possible for thrust to be exerted so that it is distributed uniformly over the conductor to be connected.

For each compartment, portion A of the housing is provided with a side orifice having a conical entrance 27 in the front face 1 of the housing, which orifice receives the conductors to be connected. The orifice is disposed between the bottom of the well 21 and the top portion of the insulation-displacement contacts 16, and it communicates with a slot 28 which extends facing the contacts 16, and which has a length chosen as a function of the number of conductors to be connected in the same compartment. In the example shown, two conductors can be connected in the same compartment.

The slot 28 is extended at 29 below the insulation-displacement contacts over a length that is sufficient to enable the conductor to be extracted, as described below.

It should be noted that the edges of that portion of the slot 28 which faces the contacts 16 are provided with resilient lips 31 and 32 which are preferably integrally molded with the housing, and which clamp the conductor after it has been connected.

The top portion 3 of portion B of the housing is closed by means of a snap-fastened strip 34.

The terminal block is used as follows:

a compartment is chosen to receive a conductor;

it is ensured that the pusher 25 is in the high position by operating the screw;

the conductor 40 is engaged in the orifice 27 until it abuts against the plate 16C;

a screwdriver 24 is used to rotate the screw 22, thereby displacing the pusher 25 downwards and driving the conductor between the sharp edges 16'A and 16'B of the insulation-displacement contacts; a rotation through 140° is normally sufficient, if, for example, a screw is chosen with 4 trapezium-shaped threads having a pitch equal to 14 mm;

the screw is rotated in the opposite direction, thereby bringing the pusher back up; and the operation can then be repeated so as to engage a second conductor which moves into place by pushing the first conductor towards the bottom of the connector.

These operations can be repeated until the maximum number of conductors is reached for the chosen compartment.

To extract a conductor, it is merely necessary to use the same screwdriver 24 to push the conductor directly downwards to the fullest extent, as shown in FIG. 3, and to pull it outwards. As described above, the lips 31 and 32 do not extend above the connector 16.

The invention is cheap to implement, because there are a small number of molded parts. Its modular nature enables it to be adapted to all requirements. It is particularly easy to use because it needs none of the special tools or accessories usually required for this type of connector.

We claim:

1. An insulation-displacement connector for connecting at least one conductor to a metal strip, the connector being provided with insulation-displacement contacts, said contacts including a plate which is folded so as to define two parallel portions terminated by convergent ends having sharp parallel edges, said connector further comprising a housing having a well provided with a screw and a threaded pusher, without slot and wire receiving openings, for pushing the conductor onto the sharp parallel edges of the contacts.

2. A connector according to claim 1, wherein the head of said screw is engaged between two circular shoulders so that the screw can rotate but is prevented from moving in translation and so that, when rotated by means of a screwdriver, said screw causes said threaded pusher to move in axial translation, while being prevented from rotating.

3. An insulation-displacement connector according to claim 1, wherein a screwdriver is used to rotate said screw through a distance of about 140 degrees, thereby displacing said pusher downwards and driving said conductor between said sharp edges of said insulation-displacement contacts.

4. A distribution terminal block, comprising at least one insulation-displacement connector for connecting at least one conductor to a metal strip, said connector being provided with insulation-displacement contacts, said contacts including a plate folded so as to define two parallel portions terminated by convergent ends having sharp parallel edges, said connector further comprising a housing having a well provided with a screw and a threaded pusher, without slot and wire receiving openings, for pushing the conductor onto the sharp parallel edges of the contacts.

5. A distribution terminal block including a plastic housing subdivided into compartments, each compartment containing an insulation-displacement connector, said connector being provided with insulation-displacement contacts, said contacts including a plate which is folded so as to define two parallel portions terminated by convergent ends having sharp parallel edges, said connector further having a well within the housing provided with a screw and a threaded pusher, without slot and wire receiving openings, for pushing the conductor onto the sharp parallel edges of the contacts, each compartment containing an opening provided in the housing, the opening being disposed between the bottom of the pusher and said insulation-displacement contacts so that a conductor to be connected can be inserted through the opening, said opening communicating with a slot extending parallel to the sharp parallel edges of the insulation-displacement connector.

6. A terminal block according to claim 5, characterized in that said slot (28) is provided with lips (31, 32) enabling the conductor to be clamped after it has been connected.

7. A terminal block according to claim 6, characterized in that said lips (31, 32) are integrally molded with the housing.

8. A terminal block according to claim 5, characterized in that the height of the insulation-displacement contacts is equal to a multiple of the diameter of each of the conductors to be connected.

9. A terminal block according to claims 5, characterized in that said slot is extended, without its lips, below the level of the insulation-displacement contacts so as to enable a conductor to be extracted merely by being pushed by a screwdriver (24).

10. An insulation displacement connector for connecting at least one conductor to a metal strip, said connector being provided with insulation displacement contacts, said contacts comprising a plate folded so as to define two parallel portions terminated by convergent ends, which have two sharp parallel edges, said connector further comprising pushing means for pushing the conductor onto the sharp parallel edges of the contacts, said pushing means including a well provided with a screw and a threaded pusher without slot and wire receiving openings, said screw being prevented from moving in translation so that when rotated by means of a screwdriver, said screw causes said threaded pusher to move in axial translation, while being prevented from rotating.

* * * * *